United States Patent [19]

Ito et al.

[11] Patent Number: 4,491,424

[45] Date of Patent: Jan. 1, 1985

[54] ELECTRONIC ANALOG TIMEPIECE WITH ROTATION DETECTION CIRCUIT

[75] Inventors: Jiro Ito, Suwa; Masuo Kitano, Matsumoto; Kenji Sakamoto, Suwa, all of Japan

[73] Assignees: Shamauchi Kieki Kabushiki Kaisha, Suwa; Kabushiki Kaisha Suwa Seikosha, Tokyo, both of Japan

[21] Appl. No.: 436,903

[22] Filed: Oct. 27, 1982

[30] Foreign Application Priority Data

Nov. 19, 1981 [JP] Japan ..... 56-185849

[51] Int. Cl.[3] ..... G04F 5/00; G04B 17/20

[52] U.S. Cl. ..... 368/157; 368/160; 318/696

[58] Field of Search ..... 368/157, 160; 318/696

[56] References Cited

U.S. PATENT DOCUMENTS 4,312,059 1/1982 Mandai et al. ..... 368/157

4,368,990 1/1983 Ueda et al. ..... 368/157

*Primary Examiner*—Bernard Roskoski

*Attorney, Agent, or Firm*—Blum Kaplan Friedman Silberman & Beran

[57] ABSTRACT

In an electronic analog timepiece an automatic sequence of events determines the proper magnitude of a detection resistor which is used in series with the motor coil so as to determine whether in normal operation the rotor is rotated or not when driven. A detection resistor is used in series with motor coil but only after a fixed time has passed from initiation of detection current flow. The detection resistor is logically variable and selected automatically in accordance with the motor's mechanical load at the time of switching on the power source or releasing the analog timepiece from a resetting operation. The resistance is formed part of the integrated circuit.

14 Claims, 39 Drawing Figures

FIG. 1
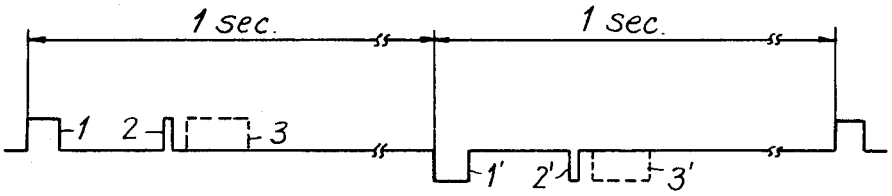
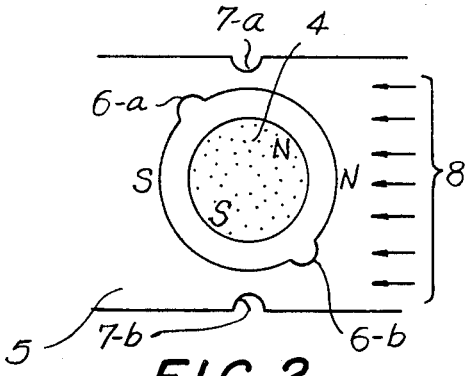
FIG. 2
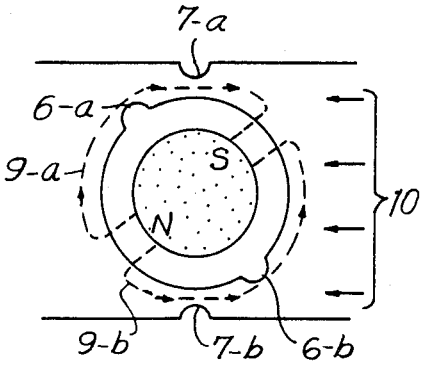
FIG. 3a
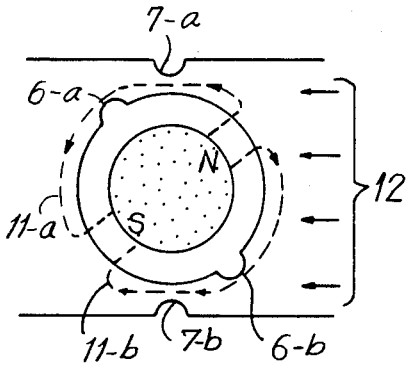
FIG. 3b

FIG. 5a
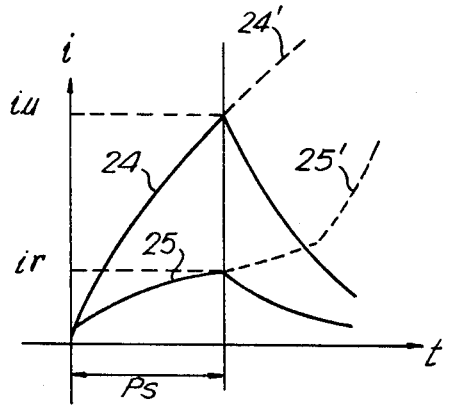
FIG. 5b
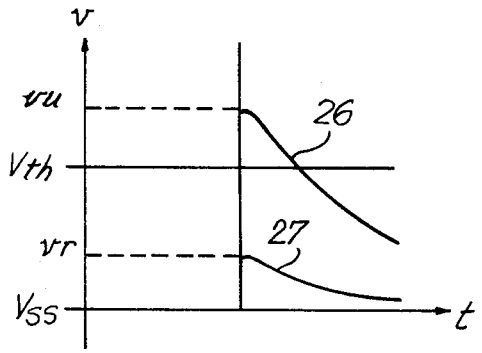
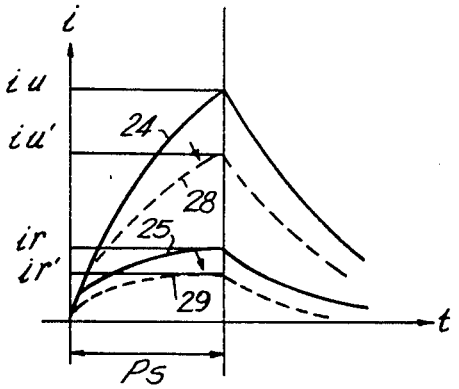
FIG. 6a
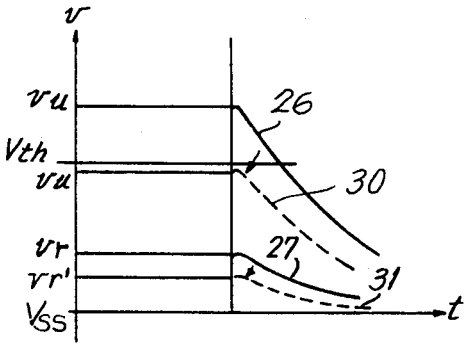
FIG. 6b

FIG. 10
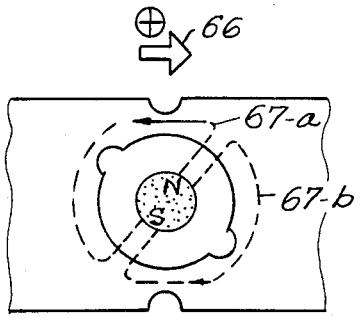
FIG. 11
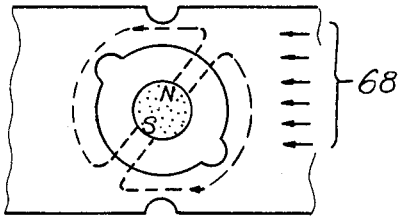
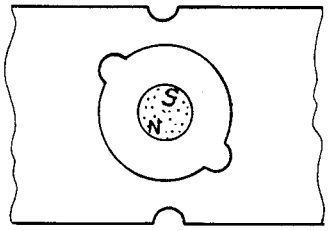
FIG. 12
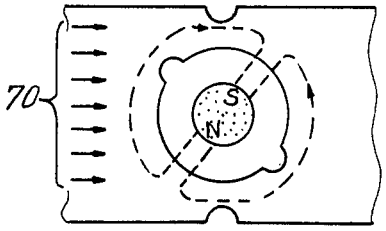
FIG. 13
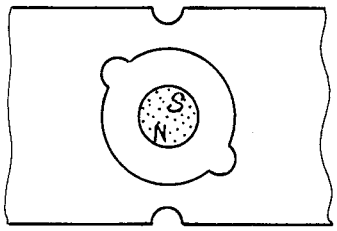
FIG. 14
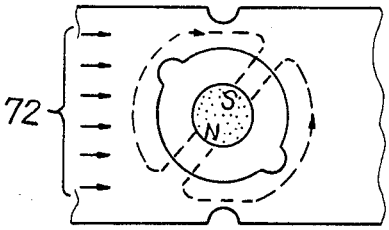
FIG. 15

FIG. 16
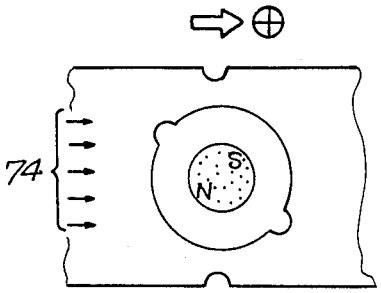
FIG. 17
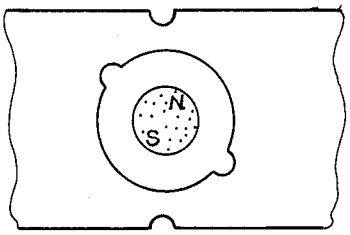
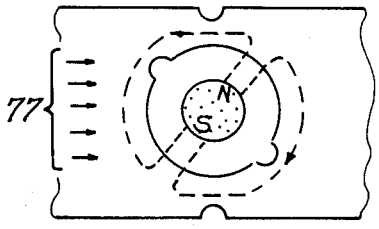
FIG. 18
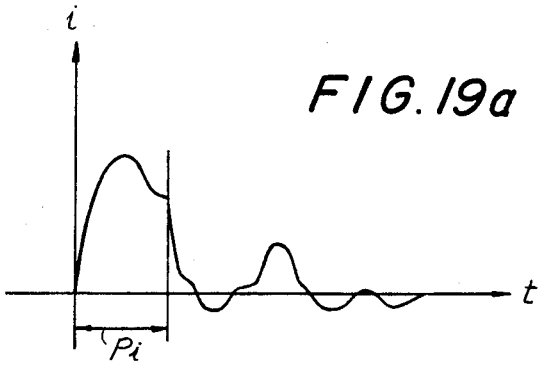
FIG. 19a
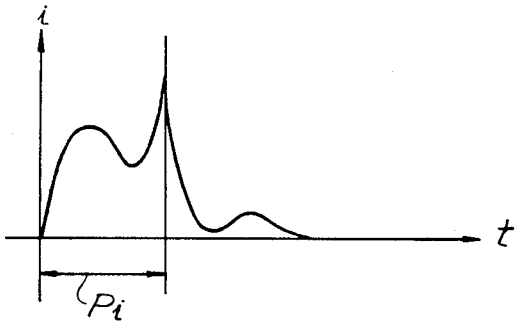
FIG. 19b FIG. 20
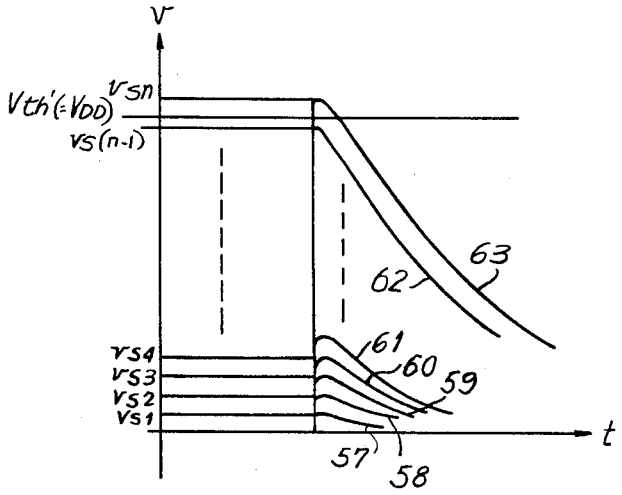
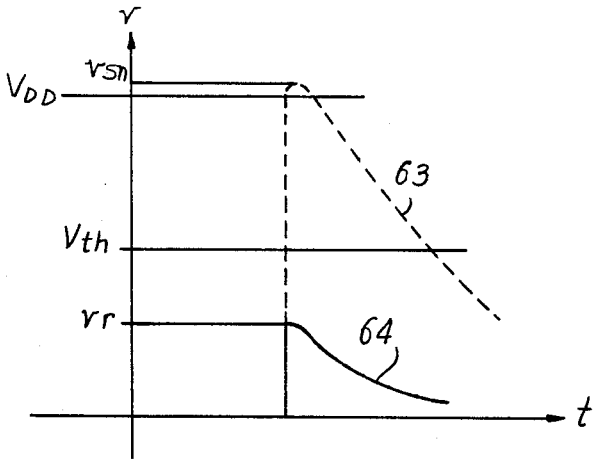
FIG. 21

FIG. 28
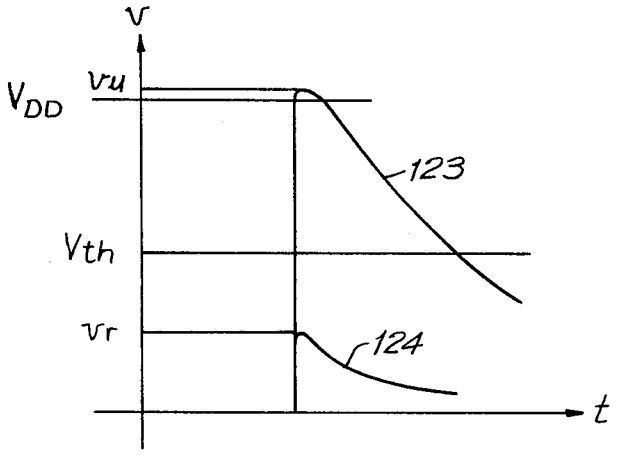
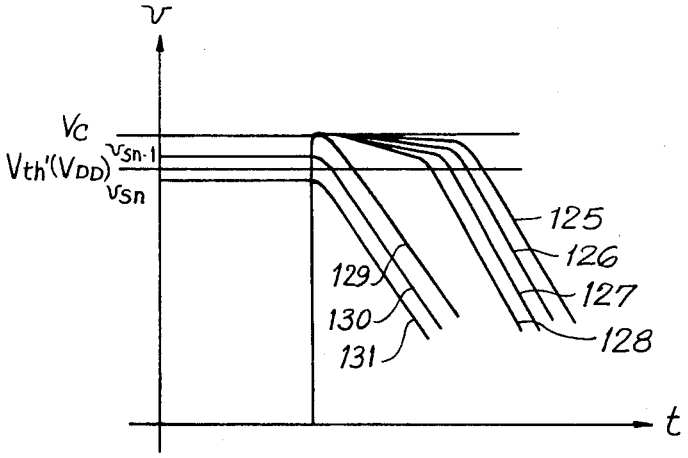
FIG. 29

ELECTRONIC ANALOG TIMEPIECE WITH ROTATION DETECTION CIRCUIT

BACKGROUND OF THE INVENTION

This invention relates generally to an analog electronic wristwatch of the type designed to optimize battery life. A very important technique to lower power consumption of an analog wristwatch is pulse width control in the pulses used to drive the step motor. It is desirable that the pulse width be no greater than is necessary to provide proper operation of the motor, that is, to have the rotor rotate 180° when the pulse is applied. When a minimal pulse is applied, a problem arises to determine whether the rotor has actually rotated or not. Currently, a method is in use wherein rotation of the rotor is determined by detecting the current induced when the rotor oscillates transiently. But this method is intended to detect a very complicated phenomenon, that is, transient oscillation of the rotor, and various factors have a major influence on the detection of whether the rotor rotates or not. As a result, mass production difficulties and cost increase substantially.

A first principle in both the subject invention and in the prior art is to sense the magnitude of generated coil inductance from the difference in the stopping position of the rotor as a difference between rates of increase in currents. In the prior art, there is the problem that it is difficult to determine the rotation of the rotor because a detection resistor is used in series with the motor coil when a detection current is applied. The difference in the detection voltage across the detection resistor is small when comparing the rotated and non-rotated positions of the rotor. For this reason, a complicated system is required such that detection current is applied two times to the rotor in both the positive and negative directions to compare the detection voltage by using one voltage as a reference. Further, the resistance of the detection resistor must be precisely controlled because a scatter in the resistances of the detection resistors directly affects the scatter in the measured detection voltages. It is desirable to form the detection resistor as an integral part of the integrated circuit of the timeplace so as to meet the demands for a small, thin and inexpensive watch. However, it is impossible to form the detection resistor precisely as the scatter of detection resistance formed as part of an integrated circuit is large. Therefore, a detection resistor of high precision must be provided externally of the integrated circuit as an independently connected component, and this prevents the production of electronic watches which are small, thin and inexpensive and at the same time have pulse width optimization for power conservation.

What is needed is an electronic timepiece with pulse width optimization for driving the motor which does not require an externally connected precision resistance in the rotor position detection circuits.

SUMMARY OF THE INVENTION

Generally speaking, in accordance with the invention, an electronic analog timepiece especially suitable for power conservation is provided. An automatic sequence of events determines the proper magnitude of a detection resistor which is used in series with the motor coil so as to determine whether in normal operation the rotor is rotated or not when driven. Polarity of the rotor magnet is reliably detected so that determination of the rotor position is also reliable. This determination is made in a very stable state, that is, where the rotor is stopped. A detection resistor is used in series with motor coil but only after a fixed time has passed from initiation of detection current flow. Then, the potential across the detection resistor is sensed. That is, current only flows through the motor coil, without the detection resistor, when the detection pulse is applied. The detection resistor is connected immediately following the detection pulse. The margin of the detection voltage to determine whether the rotor rotates or not is increased. A detection resistor is logically variable and the resistance to be used in normal operation is selected automatically in accordance with the motor's mechanical load at the time of switching on the power source or releasing the analog timepiece from a resetting operation. The resistance is formed as part of the integrated circuit used in the timepiece but the ability to logically vary the resistance within a certain range accommodates the scatter which results from manufacturing conditions. Thus, a precise value of resistance can be selected by varying the integrated circuit resistance without using an externally connected precision resistor. It is possible to realize a small, thin and inexpensive watch. Also, the ability to select the desired resistance by logical variation takes into account the different characteristics of the different motors used in the analog timepieces. Additionally, one integrated circuit can be used with many different designs of motors and standardization of the integrated circuit is enhanced.

Accordingly, it is an object of this invention to provide an improved analog electronic timepiece which allows for precise detection of rotation or non-rotation of the motor rotor without the use of externally connected precision resistors.

Another object of this invention is to provide an improved analog electronic timepiece which includes pulse width optimization circuitry for power conservation and automatically selects resistance values for proper operation of said circuitry.

A further object of this invention is to provide an improved electronic analog timepiece having pulse width optimization circuitry formed as an integrated circuit and adaptable for use with a wide range of motor designs.

Still another object of this invention is to provide an improved electronic analog timepiece having pulse width optimization and having a rotor position detection resistor formed by integrated circuit techniques and logically variable within the circuit to optimize performance.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 shows pulse waveforms as applied to a timepiece motor coil;

FIGS. 2 and 3*a*, *b* schematically illustrate operation of a stepper motor;

FIGS. 5*a*, and 6*a* are waveforms of detection currents of FIG. 4;

FIGS. 5*b*, and 6*b* are waveforms of detection voltages of FIG. 4;

FIGS. 10–18 show operations of a stepper motor;

FIGS. 19A, 19B shows waveforms of currents flowing through a stepper motor coil upon application of pulses;

FIGS. 20 and 21 show waveforms of detection voltages generated in the circuit of FIG. 7;

FIG. 28 illustrates waveforms of detection voltage produced during normal operation of a timepiece in accordance with the invention;

FIG. 29 shows waveforms of detection voltages generated by detection pulses while setting a detection resistor to the proper values;

DESCRIPTION OF THE PREFERRED EMBODIMENTS

Figure 4:
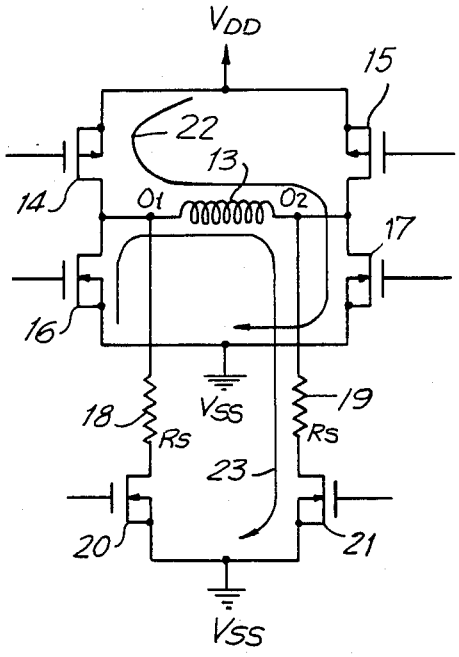
FIG. 4 is a driver circuit and detector circuit for an electronic analog timepiece in accordance with the invention.

The invention relates to an analog electronic timepiece wherein detection pulses are used to determine whether the motor rotor has rotated or not and to determine whether the motor is driven at all times with driving pulses having an optimum pulse width for low electric power consumption. In an earlier development, a motor driving technique has been considered wherein the coil of a stepper motor is supplied with an electric current by detection pulses so as to determine whether the rotor of the motor rotates or not, and to control the width of pulses supplied to the stepper motor in normal operation. This motor driving technique was designed to supply pulses of an optimum width which matches the output torque produced by the stepper motor with the condition of the load imposed by an array of wheels in the analog mechanism, thereby making the analog electronic timepiece less consumptive of electric power.

FIG. 1 illustrates the waveform of pulses applied to the coil of a motor, there being a detection pulse used for determining whether the motor rotates or does not rotate. This detection pulse is in accordance with both the earlier development for motor driving and also in accordance with the invention described herein. A drive pulse 1 has a pulse width which is assumed to be optimum for the state of the output torque requirements of the motor as determined by the load imposed by an array of wheels in the analog mechanism. A detection pulse 2 determines whether the rotor rotates or does not rotate in response to the driving pulse 1. A correction pulse 3 is generated to bring the rotor to the proper position when the rotor has not rotated in response to the pulse 1 as determined by the detection pulse 2.

The principles underlying determination of rotation or nonrotation of the rotor using a detection pulse are briefly described hereinafter. It is assumed that the rotor has magnetic poles positioned as shown in FIG. 2 before the driving pulse 1 is applied. When the drive pulse 1 is applied, the coil is energized to produce magnetic flux 8 which acts to rotate the rotor. Where the drive pulse 1 is sufficiently wide to rotate the rotor, the rotor begins to rotate to the position illustrated in FIG. 3*a*. However, if the drive pulse 1 is not sufficiently long in duration (wide), the rotor remains in the position shown in FIG. 3*b* which is the same as in FIG. 2.

When the rotor rotates as illustrated in FIG. 3*a*, magnetic flux 9, generated by the magnet of the rotor passes from left to right through saturable portions of the motor adjacent to outward notches 7-a, 7-b. As the coil is energized by the detection pulse 2, magnetic flux 10 is generated which passes through the saturable portions, which then have a smaller magnetic reluctance as a result of the superimposing fields with a resulting larger coil inductance. This occurs because the magnetic flux 10 produced by the detection pulse extends in a direction so as to cancel out the portion of the magnetic flux 9 produced by the rotor magnet. The current generated by the detection pulse, therefore, increases gradually as shown at 25 (25') in FIG. 5*a*.

When the rotor does not rotate, as illustrated in FIG. 3*b*, the rotor magnet produces magnetic flux 11 which pass from right to left in the saturable portion of the motor. Since the saturable regions have already been saturated or substantially saturated, there magnetic reluctances become larger preventing easy and smooth passage of the magnetic flux 12 which has been produced by the detection pulse 2. As a result, the coil has a lesser inductance, and the current generated by the detection pulse 2 increases more sharply as shown at 24 (24') in FIG. 5*a*. By detecting the difference between rates of increase in current, it can be determined whether the rotor has rotated or not.

FIG. 4 illustrates a circuit for determining the differences between rates of increase in current. The circuit includes P-channel transistors 14,15, N-channel transistors 16,17,20,21 and detection resistors 18,19. After a detection current flows along a path 22, as a result of an applied detection pulse 2, the current passing through transistors 14,17 and motor coil 13, the P-channel transistor 14 and the N-channel transistor 17 are turned off at the completion of the application of the detection pulse. At the same time, the N-channel transistors 16,21 are energized to cause a detection current to flow through the detection resistor 19. Thereupon, a voltage is developed across the detection resistor 19 in proportion to the magnitude of the current flowing therethrough.

FIG. 5*b* illustrates potentials, that is, detection voltages produced at the point $O_2$ at that time. A curve 26 shows a varying voltage waveform produced when the rotor is not rotated by the driving pulse 1, and a curve 27 illustrates the varying voltage waveform generated when the rotor is rotated by the driving pulse 1. The detection currents have peak values iu, ir and the detection voltages have peak values vu, vr. These peak values have the following relationships:

$$Vu \approx Rs \times iu;\ Vr \approx Rs \times ir \quad (1)$$

where Rs is the resistance of the detection resistor. Accordingly, it is determined whether the rotor is rotated or not by determining whether the peak of the detection voltage is greater or less than a reference potential Vth by using a voltage comparing elements such as, for example, a comparator.

Figure 31:
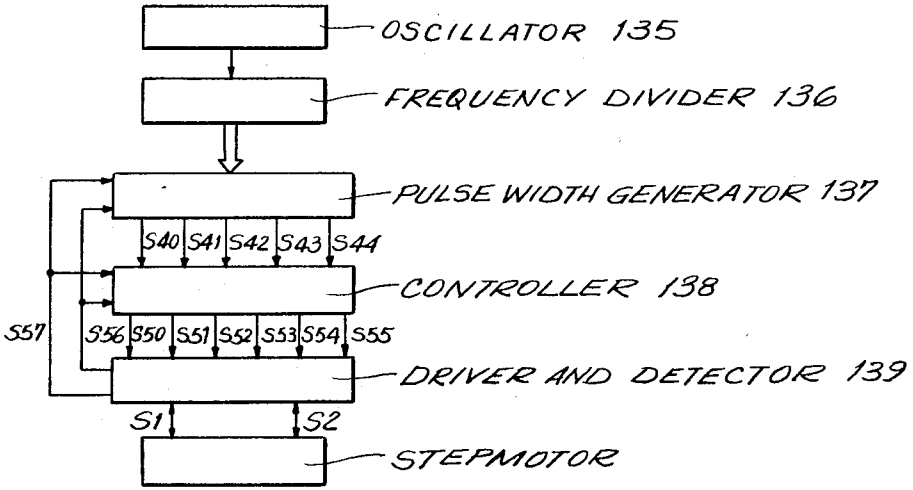
FIG. 31 is a functional block diagram of the detector and driver circuits of FIG. 4.
Figure 32:
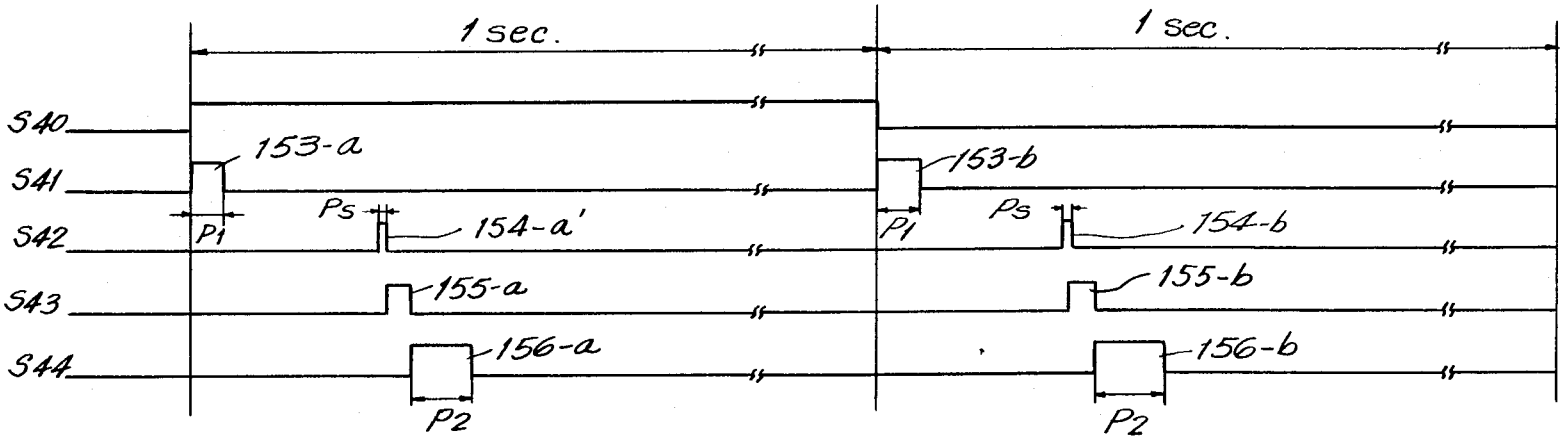
FIG. 32 shows waveforms of pulses produced by a pulse width generator of FIG. 31.

A circuit construction for carrying out the foregoing process is now described. FIG. 31 is a block diagram of a driver circuit comprising an oscillator 135, a frequency divider 136, pulse width generator 137, controller 138, and driver and detector 139. The oscillator 135 generates, by means of a quartz crystal resonator, a time standard frequency signal having a frequency of 32,768 Hz, for example, which is divided down to ½ Hz by the frequency divider 136. The pulse width generator 137 uses the divided frequency signal to form pulse waveforms S40 through S44 as illustrated in FIG. 32. Although the oscillator 135, frequency divider 136 and pulse width generator 137 are indispensable components for producing the present invention in practice, they are not a novel portion of the instant invention and accordingly, are not described in further detail herein. Such components are readily constructed as logic elements.

Figure 33:
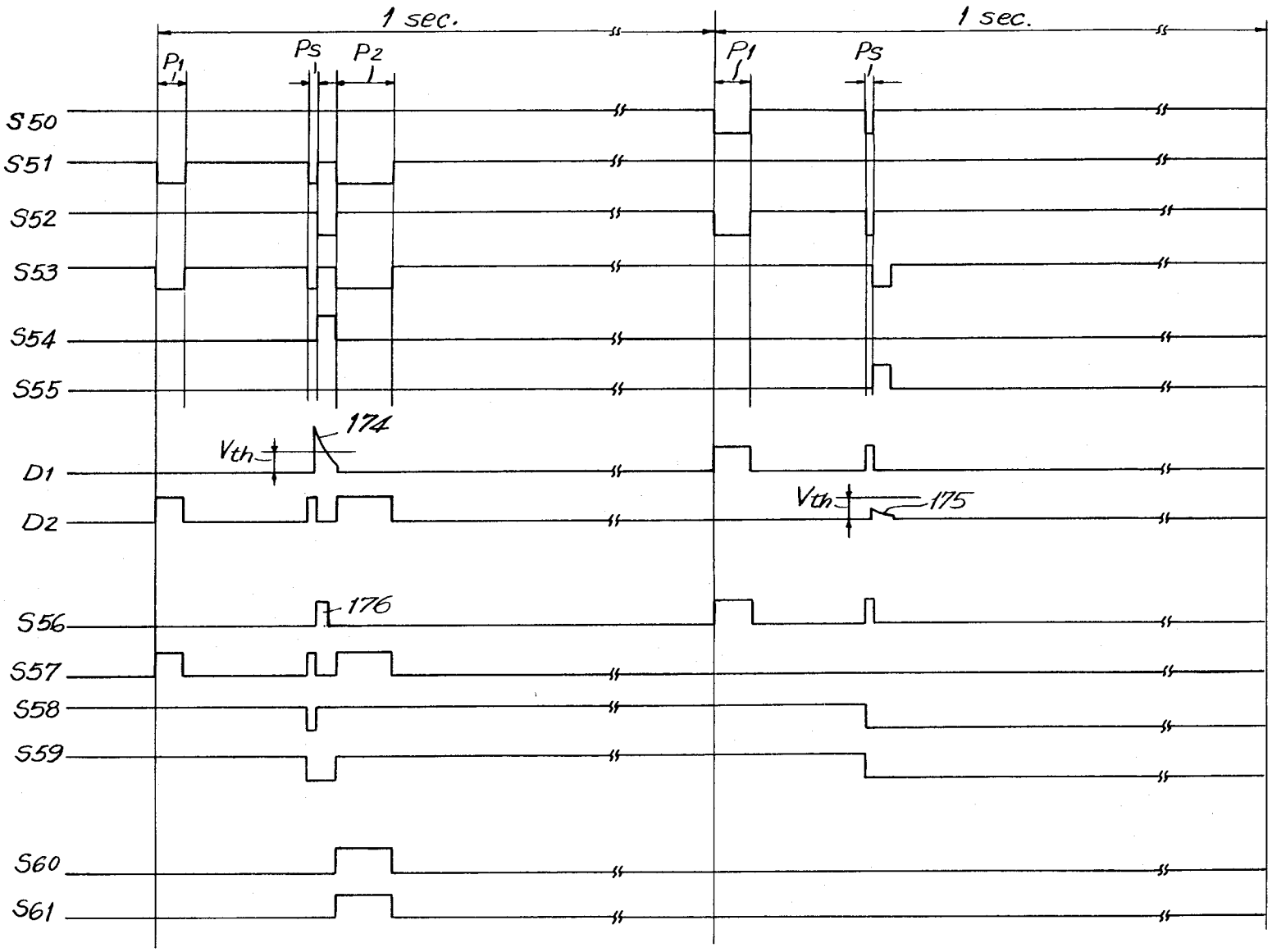
FIG. 33 is a timing chart of signals generated in a controller, driver and detector.
Figure 34:
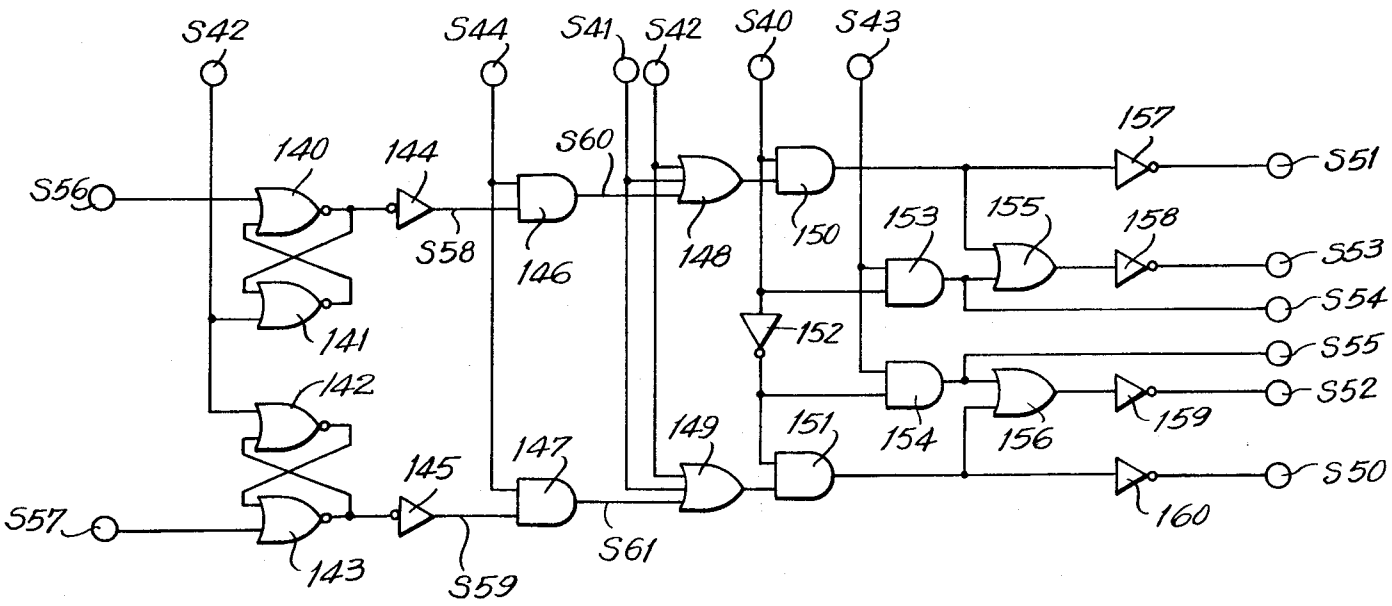
FIG. 34 is a circuit of a controller of FIG. 31.
Figure 35:
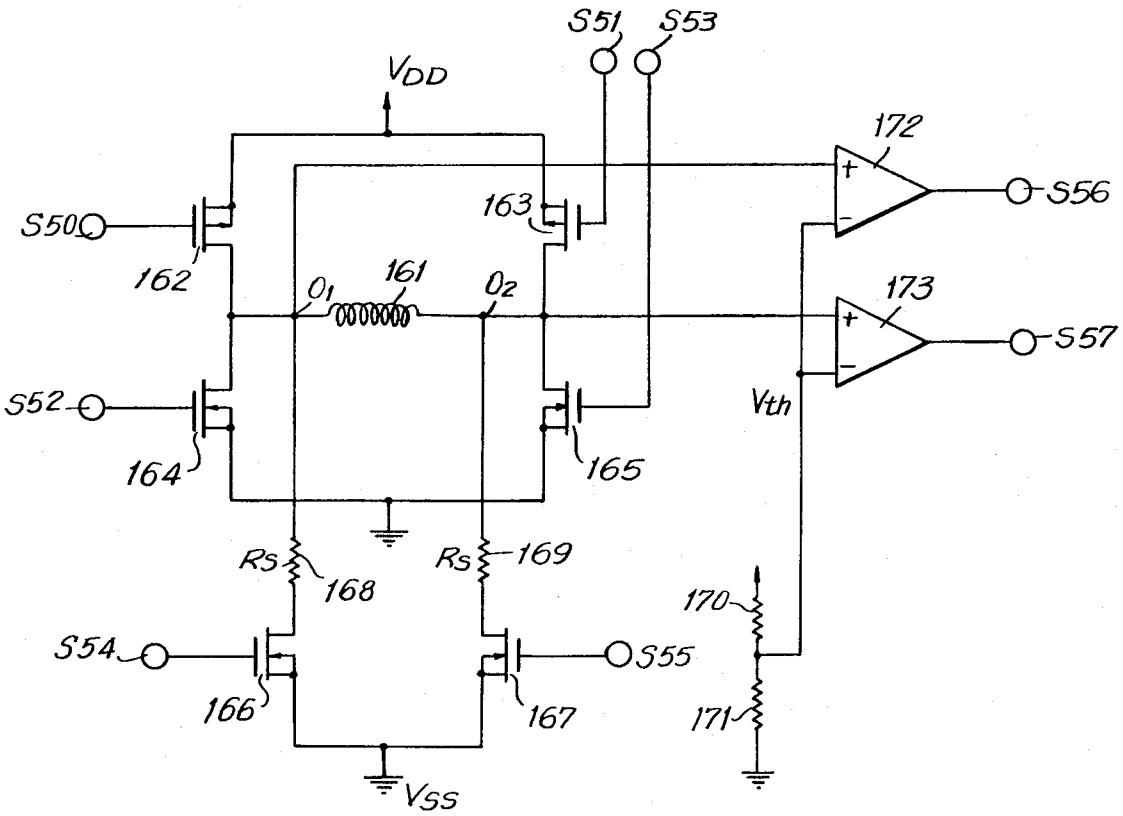
FIG. 35 is a circuit of the driver and detector of FIG. 31.

FIG. 34 illustrates a circuit for the controller 138. FIG. 35 is a circuit for the driver and detector 139, and FIG. 33 is a chart of signals generated in the controller and in the driver and in the detector.

FIG. 32 illustrates pulse waveforms produced by the pulse width generator 137 including a ½ Hz signal S40 and a signal S41 including drive pulses 153-a, 153-b having a pulse width $P_1$ for normal operation. The driving pulses 153-a, 153-b are controlled for their width by signals S56, S57 having information indicative of whether the motor rotor has rotated or not, so that drive pulses are delivered which have a pulse width dependent on the load imposed on the motor. A signal S42 includes detection pulses 154-a, 154-b having a pulse width ps. Signal S43 is indicative of detection zones 155-a, 155-b, and signal S44 includes correction pulses 156-a, 156-b of a pulse width $P_2$.

As illustrated in FIG. 35, the driver and detector 139 (FIG. 31) comprises P-channel transistors 162, 163 and N-channel transistors 164,165 which constitute a motor driver. The circuit also comprises N-channel transistors 166, 167 for switching of detection resistors 168, 169, and comparators 172, 173 for producing an output signal at a high logic level when the potential at the point $O_1$ (or $O_2$), a terminal of the motor coil 161, is larger than a reference potential Vth determined by a voltage division using resistors 170, 171. In the alternative the comparators 172, 173 produce an output at a low logic level when the potential is less than the reference potential Vth.

As illustrated in FIGS. 31 and 34, the controller 138 serves to generate signals S50 through S55 which are applied to the driver and detector 139 on the basis of the signals S56, S57 containing information indicating whether the rotor has rotated or not, and on the basis of the signals S40 through S44 produced by the pulse width generator 137.

Operation of the controller illustrated in FIG. 34 is described with reference to the timing charts of FIGS. 32 and 33. In FIG. 34, the output of an OR gate 148 goes high when the pulse 153-a is applied having the width $P_1$ based on the signal S41. At this time, the signal S40 is high, and hence, an AND gate 150 opens causing a NOT gate 157 to produce an output at a low logic level. The signal S53 also goes low because of the output of gate 150 passing through OR gate 155 and a NOT gate 158 (inverter). The signal S40 is high and one input of an AND gate 151 is low, preventing the pulse 153-a in the signal S41 from passing through the AND gate 151. Thus, the signal S50 goes high, and similarly the signal 52 goes high, whereupon the pulse $P_1$ is applied to the motor coil (FIG. 35).

The detection pulse Ps of the signal S42 follows the pulse $P_1$. Because the signals S41, S42, S43, S44 are all low during an interval after the pulse $P_1$ and before the pulse Ps, the signals S50–53 all become high. When the detection pulse 154-a of the signal S42 is applied, the signal S50 goes high, the signal S51 is low, the signal S52 is high, and the signal S53 is low as when the pulse $P_1$ on the signal S41 was applied. Thus, the pulse Ps is applied to the coil of the motor.

Then the pulse 155-a on the signal S43, which determines a detection interval is applied causing an AND gate 153 to open because the signal S40 is high at the same time. Because of the inverter 158, the signal S53 goes low. Since an AND gate 154 is low at the output, the signal S52 goes high as a result of the inverter 159, whereupon detection of rotation of the rotor is effected.

Then, the correction pulse $P_2$ is fed by means of the signal S44. Delivery of the correction pulse $P_2$ to the rotor depends on whether the rotor has rotated or not as a result of the initial pulse 153-a on the signal S41. When the rotor has not rotated, a pulse 176 on the signal S56 is applied in the detection interval, and a flip-flop which comprises NOR gates 140, 141 and a NOT gate 144 latches, and produces an output signal S58 which is at a high logic level. Therefore, an AND gate 146 opens to allow the pulse $P_2$ of the signal S44 to pass through the AND gate 146. The signals S51, S53 go low and the signals S50, S52 go high in the same process as that for the pulse $P_1$, Ps, permitting the correction pulse $P_2$ to be applied to the coil of the motor. The width of the correction pulse $P_2$ is sufficient to assure that the motor rotates.

When the rotor has been rotated by the originally applied pulse $P_1$, the signal S56 remains low in the detection interval and accordingly, the signal S58 remains low. The output of the AND gate 146 stays at the low level, thus, blocking passage therethrough of the correction pulse $P_2$ on the signal S44. Therefore, no correction pulse $P_2$ is delivered to the motor.

In the foregoing process, the peak values of voltage Vu, Vr of the detection voltages are dependent on the detection resistors Rs. Because variations in resistance of the detection resistors Rs result in varying detection voltages, these detection resistors Rs are required to be fabricated with a high level of precision. It is most desirable to fabricate such a detection resistor on an integrated circuit by way of $P^-$ diffusion, $P^+$ diffusion, ion implantation, or the like, so as to meet the demands for a small-sized, thin, and less costly timepiece. However, it is not possible to fabricate detection resistors Rs as part of integrated circuits with a high level of precision because such detection resistors are subjected to variations due to the conditions of manufacture. For example, where detection resistors are manufactured by $P^-$ diffusion, their resistances may vary within the range of ±100%, and where the resistors are fabricated by ion implantation, their resistances may vary within the range of ±20%. The detection resistors Rs can be provided outside of the integrated circuit as independent components, however, this is an arrangement which fails to meet the requirements for small-size, low-profile and low-cost watches.

When the detection current varies due to variations in the coil specifications of the motor, variations in the mechanical dimensions in the stator and rotor, and the like, the detection voltage also varies as indicated by equation (1), because the detection resistor Rs is of a fixed value of resistance. FIG. 6 illustrates such variations in the detection voltage. When the peak values of the detection current change from iu to iu' and from ir to ir' for some reason (FIG. 6*a*), the peak values of the detection voltage also change from vu to vu' and from vr to vr' as illustrated in FIG. 6*b*.

As FIG. 6*b* illustrates, the voltage vu' could be considered to indicate rotation of the rotor from a comparison with the reference potential Vth. Although the above example is an extreme case, and is unlikely to be encountered, it sufficiently suggests the fact that variations in detection currents for stepper motors lead to narrower margins when determining whether the rotor has rotated or not. Various circuit constants need to be selected taking into account the variations in coil specifications, variations in the mechanical dimensions of the rotor and stator, and the like, thus, placing burdens on design and requiring experimentation.

Where specifications for movements differ, as, for example, watches used by men vary from those watches for use by women, stepper motors have different mechanical dimensions. Detections resistors Rs need to be of values selected to suit various stepper motors, which results in an obstacle to standardization of watch movements and integrated circuits.

It is an object of the invention to provide a rotation detection circuit which eliminates the foregoing disadvantages and requires no resistor connected externally to an integrated circuit, so that watches incorporating such a circuit will be small in size, low in profile and less costly to manufacture.

Another object of the invention is to automatically select resistors Rs which are best suited for the particular stepper motor to thereby accommodate for variations in characteristics of the stepper motors.

Still another object of the invention is to permit integrated circuits having uniform specifications to be adaptable to all systems for controlling pulse widths for driving stepper motors, so that the integrated circuits can be standardized for various applications.

In the circuits in accordance with the invention, the resistances of the detection resistors Rs are variable within a particular range through a logic construction taking into consideration the fact that the resistances on integrated circuits undergo some variations depending upon the conditions in which the integrated circuits are fabricated. The above objects are achieved by automatically selecting a detection resistor having an optimum resistance value best suited for the stepper motor when the power supply cell supplied with the watch is switched on, or the watch is released from a resetting procedure.

Figure 7:
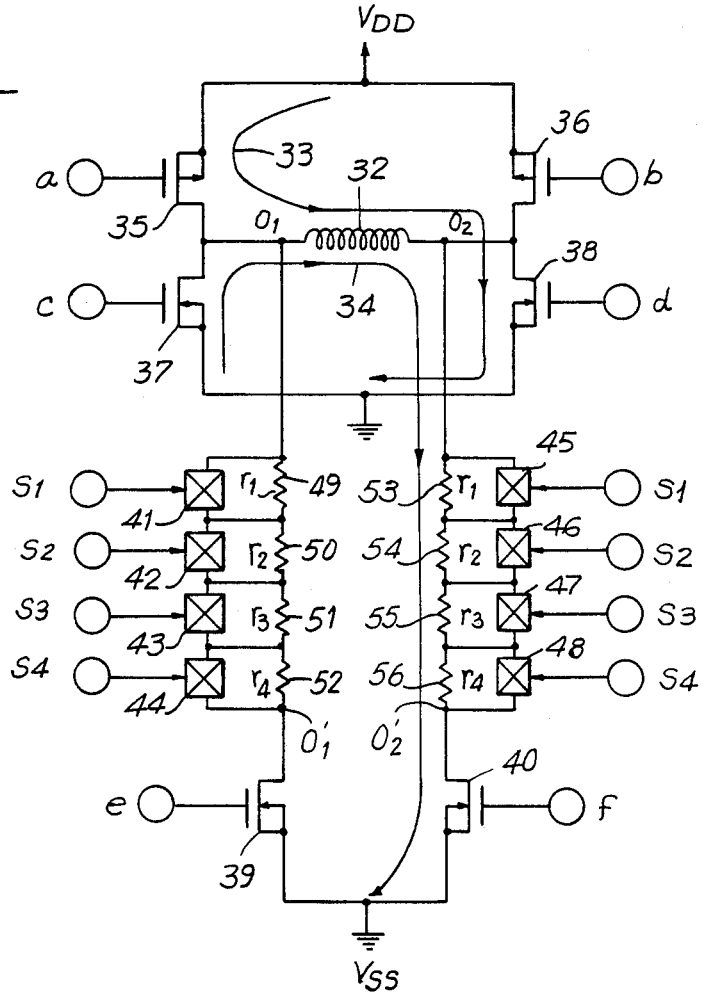
FIG. 7 is a circuit for detection of rotor position in an electronic analog timepiece in accordance with the invention.

The invention is described hereinafter in detail with reference to various embodiments thereof. FIG. 7 illustrates a driver circuit and a detector circuit in accordance with the invention. The circuit includes P-channel transistors 35, 36, N-channel transistors 37–40 , detection resistor elements 49–56 fabricated as an integrated circuit, transmission gates 41–48, and control terminals $S_1$–$S_4$ for the transmission gates 41–48. The resistor elements 49–56, hereinafter referred to as detection resistors, between points $O_1$ and $O_1'$ and between points $O_2$ and $O_2'$ are selectively determined. A current loop or path 33 indicates the direction of current flow when a detection pulse is applied, and a current loop 34 flowing through a detection resistor indicates the path of flow after the detection pulse has been applied.

The relationships between signals applied to the control terminals $S_1$–$S_4$ for the transmission gates and resistances Rs of the detection resistors, that is, the resistances between the points $O_1$ and $O_1'$ and between the points $O_2$ and $O_2'$, can be readily seen in FIG. 7 and can be represented by the equation as follows:

$$Rs=\bar{S}_1r_1+\bar{S}_2r_2+\bar{S}_3r_3+\bar{S}_4r_4 \quad (2)$$

It is assumed that the resistances of the transmission gates 41–48 are negligible when the gates are energized. When the signal at the terminal $S_1$ is 0, that is, at a low logic level, the transmission gate 41, 45 is open and the resistor elements $r_1$ 49, 53 are selected, that is, remain in the circuit. When the signal at the terminal $S_1$ is 1, that is, at a high logic level, the transmission gates 41, 45 are turned on and the resistor elements r1 are not selected, that is, shorted out of the circuit by the closed transmission gates. While it is possible to have different resistances for the detection resistors between the points $O_1$ and $O_1'$ and between the points $O_2$ and $O_2'$, no characteristic difference results due to a difference between coil directivities, and no appreciable effect is brought about by establishing different detection resistances. The following description is based on an assumption that the resistances, that is, the detection resistors between the points $O_1$ and $O_1'$ and the points $O_2$ and $O_2'$ are equal.

As indicated in equation (2), various ways are possible for establishing the resistances of the detection resistor elements $r_1$, $r_2$, $r_3$, $r_4$. In accordance with an exemplary embodiment, the following relationship will be assumed for establishing resistances in the equal increments:

$$r_4=2r_3=4r_2=8r_1 \quad (3)$$

With the detection resistor elements selected thusly, the detection resistor Rs is available in resistances in equal increments from zero to $(r_1+r_2+r_3+r_4)$. The optimum detection resistor Rs ideally is selected such that the peak value vr of the detection voltage upon rotation of the rotor, differs most widely from the peak value vu when the rotor does not rotate. Therefore, the detection resistor should be established so as to equalize the peak voltage vu substantially with the power supply voltage ($V_{DD}$).

With the foregoing conditions presupposed in the exemplary embodiment, it is assumed that the optimum detection resistor Rs has a resistance of 15,000 ohms, which makes the peak voltage vu equal to $V_{DD}$. The resistor elements fabricated on the integrated circuit are constructed such that $r_1+r_2+r_3+r_4$ is 15,000 ohms or more, taking into account variations experienced in fabrication of integrated circuits.

It is now further assumed that resistors can be fabricated on integrated circuits in a range of resistances from 15,000 to 30,000 ohms, which, in fact, are practically feasible with currently available fabrication techniques and processes. (Variations in the resistance of an ion implanted resistor are within ±20%.) Consideration is now given to establishing a detection resistor where $r_1+r_2+r_3+r_4=30{,}000$ ohms under the worst fabricating conditions. When the individual resistances satisfy equation (3), $r_1$ is 2,000 ohms, $r_2$ is 4,000 ohms, $r_3$ is 8,000 ohms, and $r_4$ is 16,000 ohms. The relationships between the signals at the control terminals $S_1$, $S_2$, $S_3$, $S_4$ of the transmission gates and the resistances of the resultant detection resistor Rs are presented in Table 1 where it is shown that detection resistors ae available in a range of from zero to 30,000 ohms in increments of 2,000 ohms.

TABLE 1

| Control signal | | | | Detection resistor |
|---|---|---|---|---|
| $S_4$ | $S_3$ | $S_2$ | $S_1$ | Rs in thousands |
| 1 | 1 | 1 | 1 | 0 |
| 1 | 1 | 1 | 0 | 2 |
| 1 | 1 | 0 | 1 | 4 |
| 1 | 1 | 0 | 0 | 6 |
| | : | | | : |
| 1 | 0 | 0 | 0 | 14 |
| 0 | 1 | 1 | 1 | 16 |
| | : | | | : |
| 0 | 0 | 0 | 1 | 28 |
| 0 | 0 | 0 | 0 | 30 |

The ideal resistance is 15,000 ohms, and the resistance 14,000 or 16,000 as shown in Table 1, which values are close to the ideal resistance, is selected by means of a logic procedure. For example, where the resistance of 16,000 ohms is to be selected, the control terminals $S_1$, $S_2$, $S_3$ and $S_4$ of the transmission gates are low, high, high, and high, respectively, in logic level.

Figure 8:
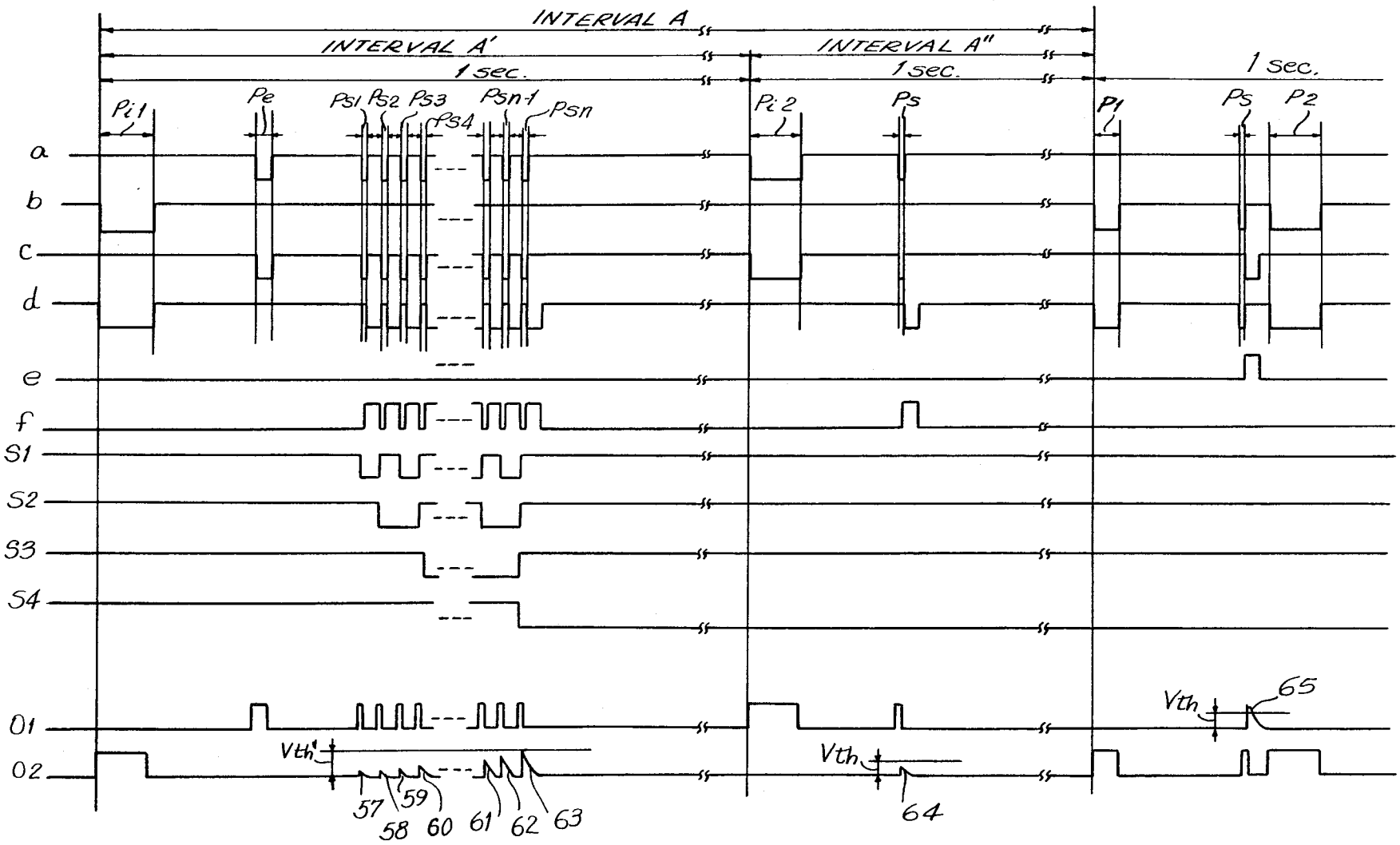
FIG. 8 illustrates timing waveforms for operation of the circuit of FIG. 7.

Operation for establishing a resistance for the detection resistor is now described. FIG. 8 is a timing chart showing waveforms of signals at gate terminals a–f and control terminals $S_1 \ldots S_4$ of the transmission gates, as illustrated in FIG. 7. An interval A (FIG. 8) is a time period in which the resistance value for the detection resistors Rs is determined so as to be suitable for the individual stepper motor. After the period A occurs, a normal operation interval in which it is determined where the stepper motor is rotated or not rotated as the stepper motor is driven with pulses having a pulse width best suited for the state of the output torque generated by the motor and condition of the load imposed by the series of mechanical wheels. The subject invention is not directed to such a normal operation zone, and therefore, it is not described in detail herein. The interval A commences immediately after the power supply cell has been switched ON or the watch has been released from a resetting procedure.

$Pi_1$, $Pi_2$ occurring within the interval A (FIG. 8) are large output pulses, hereinafter referred to as "initialization pulses". Pe is a demagnetization pulse for controlling the magnetic hysteresis conditions due to application of the intialization pulses. Ps, $Ps_1$, $Ps_2$, $Ps_3 \ldots Psn-_1$, Psn are detection pulses for establishing the detection resistor Rs. In experimentation, pulse widths were as follows: $Pi_1=Pi_2=6.8$ msec, Pe=0.7 msec, Ps, $Ps_1$, $Ps_2 \ldots Psn=0.36$ msec.

Figure 9:
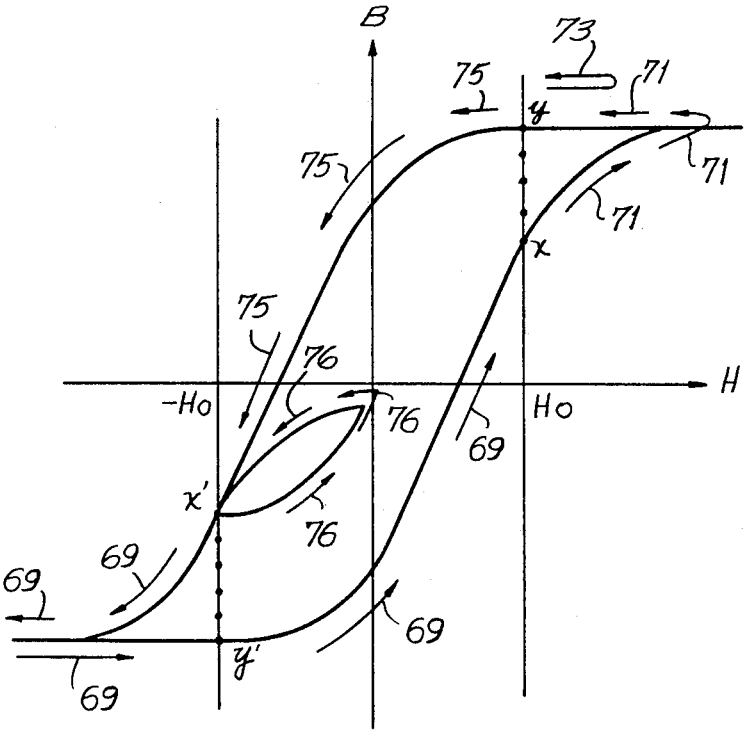
FIG. 9 is a magnetic hysteris curve associated with the circuit of FIG. 7.

The purposes served by the initialization pulses $Pi_1$, $Pi_2$, the demagnetization pulse Pe, and the detection pulses Ps, $Ps_1 \ldots Ps_n$, are described with reference to a magnetic hysteresis curve for the saturable portion of the stator. FIG. 9 illustrates such a magnetic hysteresis curve for the saturable portions of the stator. As indicated in FIG. 9, Ho and −Ho are the intensities of a magnetic field applied by a rotor magnet to the saturable region when the rotor is in a stationary stable position. It is assumed that the magnetic poles of the rotor are positioned as shown in FIG. 10 before the initialization pulse $Pi_1$ is applied. With the arrow 66 in FIG. 10 defined as a positive direction for the magnetic field, the saturable portions are subjected to a magnetic field of −Ho, a condition which lies on a line x′—y′ of the magnetic hysteresis curve illustrated on FIG. 9. The point on the line x′—y′ which is taken depends on the magnetic hysteresis characteristic.

It is assumed that the position x′ is taken prior to application of the initialization pulse $Pi_1$, and when the initialization pulse $Pi_1$ is applied, magnetic flux 68 is generated in a direction to rotate the rotor as shown in FIG. 11. Because the pulse $Pi_1$ is large (wide), the rotor is caused to rotate to the position illustrated in FIG. 12. At this time, the magnetic hysteresis curve of FIG. 9 is followed as indicated by the arrow 69 until a point x—y on the line is reached. The position on the line x—y which is taken depends on the magnitude of transient vibration produced when the rotor rotates.

FIG. 19 illustrates waveforms of currents flowing through the motor coil upon application of the pulse $Pi_1$. When the pulse Pi is short and a large induced current flows due to transient vibrations as illustrated in FIG. 19*a*, a point closer to the point y on the magnetic hysteresis curve is taken. Conversely, when the pulse Pi is wide and a small induced current flows due to transient vibrations as shown in FIG. 19*b*, a point is taken on the hysteresis curve which is closer to the point y. Because the initialization pulse applied is of a large magnitude to bring the rotor reliably to a desired rotated position, a point closer to the point x will be picked up in all probability.

The foregoing description is based on the assumption that the rotor is positioned as shown in FIG. 10 prior to application of the initialization pulse $Pi_1$, and the magnetic flux due to application of the initialization pulse $Pi_1$ is directed as illustrated in FIG. 11, with the rotor being rotated by the initialization pulse $Pi_1$. However, since it is necessary to prevent movement of the watch hands in the one-second immediately after the watch has been released from a resetting procedure, the current produced by the initialization pulse $Pi_1$ should flow in the direction in which the current flows just before resetting when the zone A for establishing the detection resistor is inserted right after the watch has been released of resetting. Therefore, the pulse $Pi_1$ should be applied in a direction to attract the rotor, instead of rotating the rotor. The point x on the magnetic hysteresis curve of FIG. 9 is taken both prior to and subsequent to application of the pulse $Pi_1$. At any rate, the point x on the magnetic hysteresis curve is taken after the pulse $Pi_1$ has been supplied.

The purpose of the demagnetization pulse Pe is now described. As illustrated in FIG. 8, the demagnetization pulse Pe is applied in a direction or polarity opposite to that of the initialization pulse $Pi_1$. FIG. 13 illustrates such a condition wherein magnetic flux 70 is generated by the demagnetization pulse Pe and directed in the positive direction. The demagnetization pulse Pe is of a pulse width, for example, 0.7 msec, which is too small to rotate the rotor. Thus, the rotor remains in the position shown in FIG. 14. At this time, the magnetic hysteresis curve (FIG. 9) is followed from the point x in the direction of the arrows 71 to the point y.

Detection pulses $Ps_1$, $Ps_2$ . . . $Ps_n$ are now described and their function. These detection pulses Ps are applied in the direction in which the demagnetization pulse Pe is applied (FIG. 8). FIG. 15 illustrates the position of the rotor at this time and the direction in which the magnetic flux 72 is produced by the detection pulses, the direction being positive. The magnetic hysteresis curve of FIG. 9 is followed from the point y along a loop shown by the arrow 73 back to the point y. Since the magnetic permeability $\mu = dB/Dh$ is small and the magnetic reluctance is large at the saturable regions, the coil inductance is reduced and the current generated by the detection pulses increases sharply.

The second initialization pulse $Pi_2$ in the interval A" and its function are now described. FIG. 16 illustrates the position which the rotor takes when the initialization pulse $Pi_2$ is applied, and also illustrates the magnetic flux 74 generated by the pulse $Pi_2$. Since the initialization pulse $Pi_2$ is of an increased magnitude, for example, having a pulse width of 6.8 msec, the rotor is caused to rotate, without possible failure to rotate, to the position shown in FIG. 17. At this time, the magnetic hysteresis curve (FIG. 9) is followed along the arrows 75 to the point x'.

The function of the detection pulse Ps in the zone A" is now described. FIG. 18 shows the position of the rotor when the detection pulse Ps is applied, and magnetic flux lines 77 produced by this detection pulse. At this time, a minor loop is traced from the point x' along the path defined by the arrows 76 back to the point x' (FIG. 9). As the magnetic permeability $\mu$ is large and the magnetic reluctance is small, the coil inductance is increased, so that the detection current rises slowly.

The foregoing description relates to the functions of the initialization pulses $Pi_1$, $Pi_2$, the demagnetization pulse Pe, the detection pulses Ps, $Ps_1$ . . . $Ps_n$ in the zone A for establishing the value of the detection resistor. Operation for determining the detection resistor in the zone A is now described with reference to the timing chart of FIG. 8. First the function of the detection pulses Ps in the zone A' is described.

When the detection pulse $Ps_1$ is applied, the control terminals $S_1$–$S_4$ of the transmission gates produce outputs at low, high, high, and high logic levels, respectfully and only the resistor element $r_1$ is selected such that the detection resistor(s) Rs is equal to the resistor $r_1$. The detection current generated by the detection pulse flows in the loop 33 shown in FIG. 7. After the detection pulse has been removed, the current flows in the loop 34 through the detection resistor whereupon a voltage is developed at the terminal $O_2$ at one end of the coil in proportion to the magnitude of the detection current.

The voltage thus generated is shown at 57 on the terminal $O_2$ in FIG. 8. The detection voltage 57 has a peak value $vsi \cong iu \times r_1$ where iu is the peak value of the detection current. When the second detection pulse $Ps_2$ is applied, the control terminals $S_1$–$S_4$ become high, low, high and high, respectively, whereupon the detection resistor Rs has a resistance $Rs = r_2\ (2r_1)$. At this time, the detection voltage 58 has a peak value $vs_2 \cong iu \times r_2$. Each time the detection pulse is applied, the detection resistor increases step-wise, with the result that the detection voltages 59, 60 . . . 61, 62, 63 increase in proportion to the detection resistor as the resistor increases in value. At the detection resistor gets progressively larger, the detection voltage will at some point, such as the peak 63, exceed a reference potential Vth', the detection voltage being of the peak value vsn.

By selecting the reference Vth' so as to be the same as, or close to, the power supply voltage $V_{DD}$, the difference between the detection voltages Vu, Vr generated when the rotor is rotated and not rotated during normal operation, becomes large, providing an increased margin of safety available to determine whether the rotor rotates or not. The resistance of the detection resistor Rs which gives the first detection voltage that goes beyond the reference potential Vth' ($=V_{DD}$) constitutes a detection resistance value best suited for the characteristics of the stepper motor.

FIG. 20 shows the potential of the terminal $O_1$, or the detection voltage, as it increases in increments when the resistance of the detection resistor Rs is increased by steps. In FIG. 20, the voltage vsn is the first voltage which exceeds the reference potential (Vth', $=V_{DD}$), and the detection resistor which produces the voltage vsn is selected to be the optimum detection resistor.

Operation in the zone A" within the zone A for establishing the detection resistor is now described with reference to the timing chart of FIG. 8. The operations in the zones A" serve to ascertain whether the detection resistor established in zone A' is appropriate or not. As described above, the second initialization pulse $Pi_2$ is a large output pulse, and hence, the rotor is caused by this pulse to rotate without fail. Thus, the detection current produced by the detection pulse Ps increases gradually. When the detection current flows through the detection resistor Rs selected in the zone A', the detection voltage appears as a waveform having a small peak value in FIG. 8. FIG. 21 shows a voltage waveform 64 drawn to an enlarged scale. When it is known that the peak value vr of the detection voltage 64 is less than the reference voltage Vth, it is confirmed that the resistance of the detection resistor which has been selected in the zone A' is suitable. The voltage waveform 63, shown in broken lines in FIG. 21, is a waveform of the detection voltage generated by the detection pulse $Ps_n$ in the zone A'.

Figure 22:
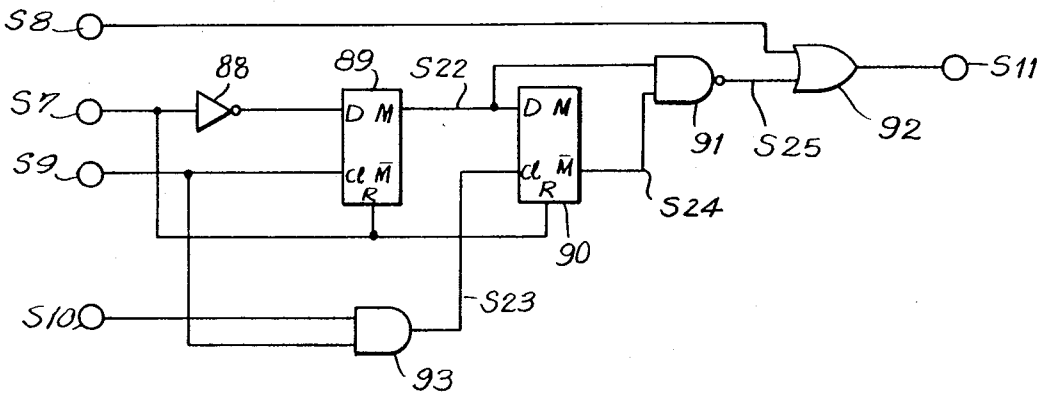
FIG. 22 is a circuit for providing a mask signal while setting a detection resistor value.
Figure 23:
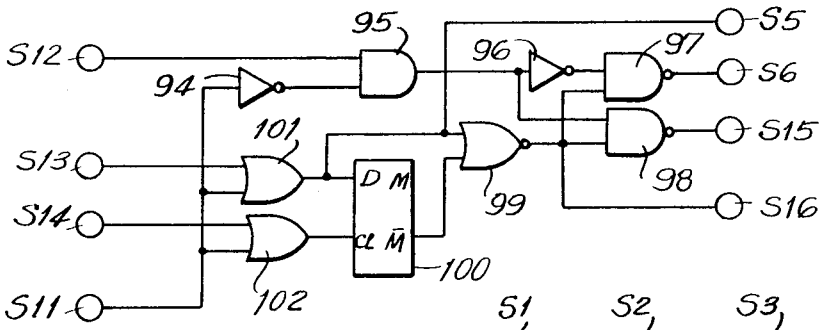
FIG. 23 is a circuit for generating a detection signal.
Figure 24:
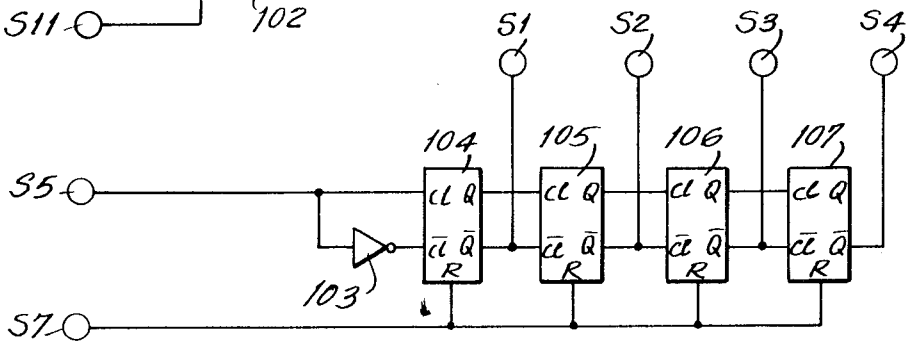
FIG. 24 is a circuit for establishing the value of a detection resistor.
Figure 25:
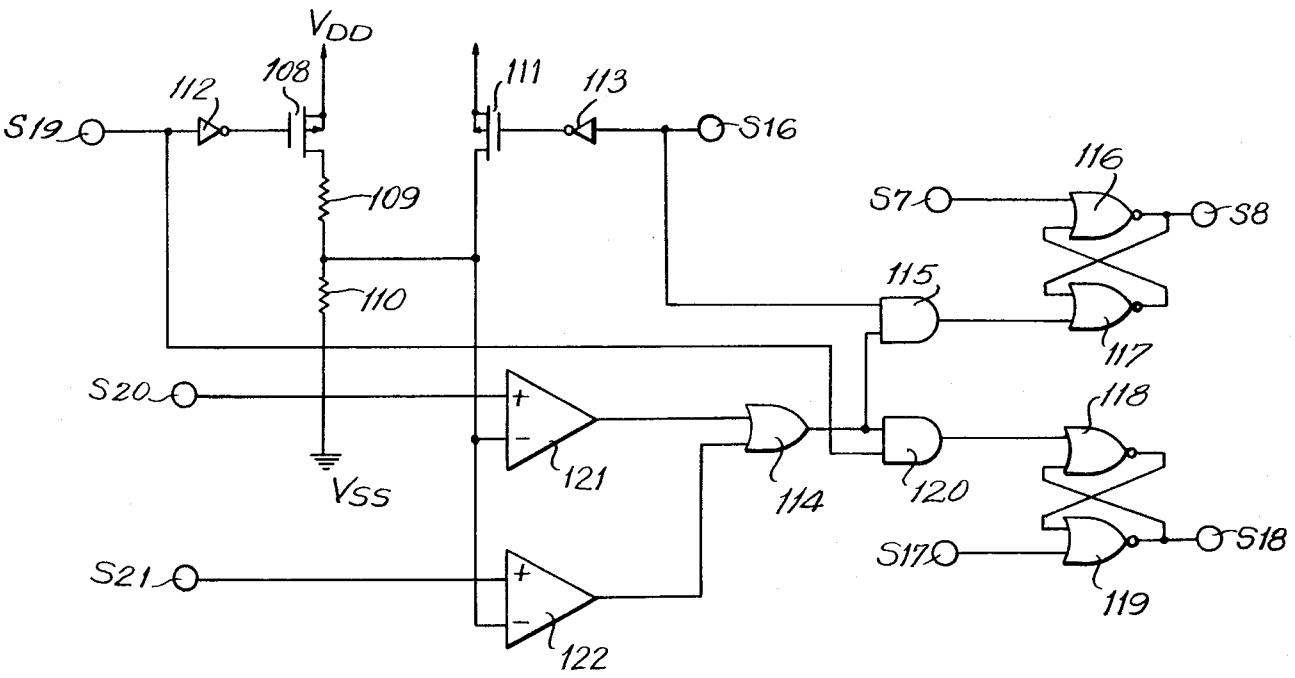
FIG. 25 is a circuit for comparing detection voltages at a rotor coil with a reference voltage.
Figure 27:
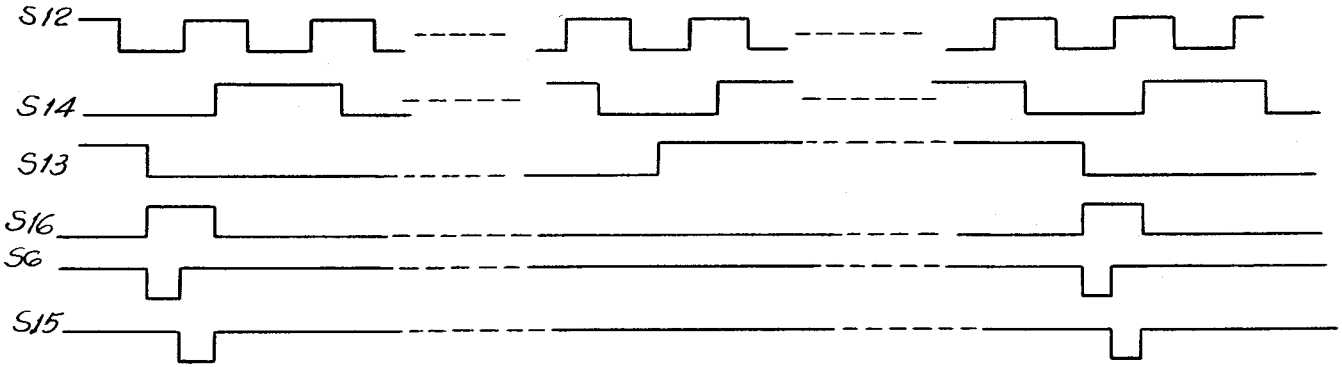
FIG. 27 is a timing chart of operations of the circuit of FIG. 23.
Figure 26:
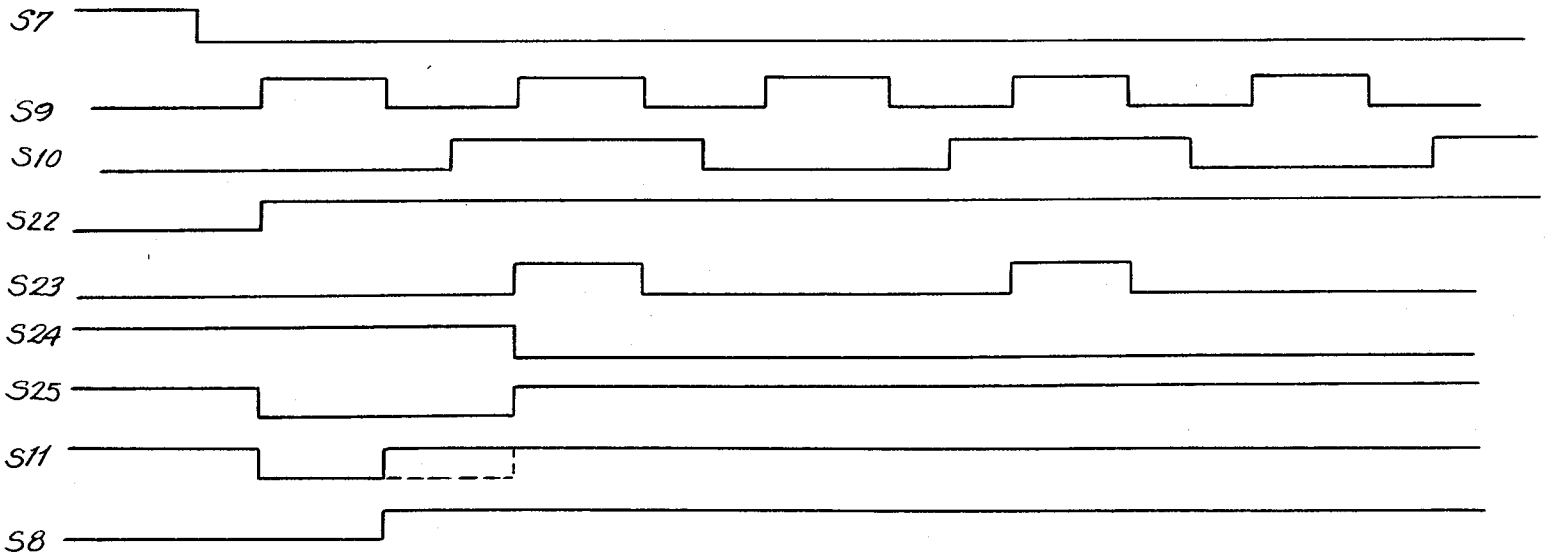
FIG. 26 is a timing chart associated with the operation of the circuit of FIG. 22.

Automatic setting of the detection resistor Rs is now described in detail with reference to actual circuits and timing charts. FIG. 22 is a circuit for producing a masking signal in the detection resistor establishing or setting zone. FIG. 23 is a circuit for generating detection signals. FIG. 24 is a circuit for establishing or setting a detection resistor, and FIG. 25 is a circuit for comparing detection voltages at $O_1$, $O_2$ with a reference potential. FIG. 26 is a timing chart for operation of the circuit shown in FIG. 22, and FIG. 27 is a timing chart for operation of the circuit shown in FIG. 23.

The circuit FIG. 22 includes a NOT circuit 88, half-latch circuits 89, 90 with reset terminals, a NAND circuit 91, OR circuit 92, and AND circuit 93. The half-latch circuits allow data to pass when a clock signal is high in logic level and to be held when the clock signal is low. Other half-latch circuits described herein operate in the same way. The words "high" and "low" are used with reference to logic levels. Signals are marked with the same reference numerals as those in the timing chart of FIG. 26. A signal $S_7$ goes high when the power supply is switched ON and upon resetting. A signal $S_8$ goes high when the detection voltage at the point $O_1$ or $O_2$ is equal to the reference voltage. A master signal $S_9$ is fed from a stage of frequency division, and another master signal $S_{10}$ is fed from a stage of frequency division. A signal $S_{22}$ is obtained by delaying the signal $S_7$, and a signal $S_{24}$ is obtained by delaying the signal $S_{22}$ with a clock signal $S_{23}$. A signal $S_{25}$ occurs in the time zone for automatically setting the detection resistor.

When the signal $S_{25}$ goes low, the circuit comes into an automatic setting mode of operation. When the signal $S_8$ determining the level of the detection voltage goes high, the voltage $O_1$ and $O_2$ is indicated thereby to be greater than the reference potential. A signal $S_{11}$ is a combination of signals $S_{25}$ and the signal 8. When the signal $S_8$ goes high, the signal $S_{11}$ also goes high, whereupon the detection resistor is established.

The circuit of FIG. 23 includes NOT circuits 94, 96, AND circuit 95, NAND circuits 97, 98, NOR circuit 99, OR circuits 101, 102, and a half-latch circuit 100. Signals are indicated by the same reference numerals as those shown in the timing chart of FIG. 27. $S_5$ is a count-up signal for a counter for setting the detection resistor. $S_6$ is a sampling signal for detecting the setting of the detection resistor. $S_{15}$ is a current output signal for detecting the setting of the detection resistor. $S_{16}$ is a detection zone signal, and $S_{12}$ is a current setting signal for detecting the setting of the detection resistor. $S_{13}$ is a period setting signal for detecting the setting of the detection resistor, and $S_{14}$ is a zone setting signal for detecting the setting of the detection signal.

The circuit of FIG. 24 includes a NOT circuit 103, frequency divider circuits 104–107 for producing outputs Q which change at the trailing edges of a clock signal, and $S_1$–$S_4$ are control signals for transmission of the detection resistor.

The circuit of FIG. 25 includes a P-channel MOS transistor 108, resistors 109, 110 for generating a reference voltage, a P-channel transistor 111, NOT circuits 112, 113, OR circuits 114, AND circuits 115, 120, NOT circuits 116–119 which constitute 2 RS latches, and comparator circuits 121, 122. Denoted at $S_{17}$ is a reset signal for detecting rotor rotation. $S_{18}$ is a rotation detecting signal; $S_{19}$ is a rotation detection zone signal; $S_{20}$ is a signal from the terminal $O_1$, and $S_{21}$ is a signal from the terminal $O_2$.

When the power supply is switched on or the watch is reset by moving the watch hands in an analog manner, the signal $S_7$ goes high. At this time, the counter for setting the detection resistor is reset, with the result that the signals $S_1$–$S_4$ all are at the high or one state. When oscillation begins in the timekeeping mechanism or the watch is released from resetting, the signal $S_7$ becomes low. Simultaneously, the signals b, d, (FIG. 7) go low, causing a current flow from the point $O_1$ to $O_2$ for forced determination of the polarity of the rotor. This current flow constitutes the pulse $Pi_1$ (FIG. 8). The current may flow either from point $O_1$ to the point $O_2$ or from the point $O_2$ to the point $O_1$ when the power supply is switched ON.

When the watch is released from resetting, the current should flow in the direction in which it has flowed just prior to releasing the watch from resetting so as to prevent the hands from moving immediately after the watch has been released from resetting. Then, the demagnetization pulse Pe is applied in the direction opposite to that of the current generated by the drive pulse $Pi_1$ in order to demagnetize the stator. The signal $S_{11}$ now goes low to enter a mode for automatically setting the detection resistor. The signal $S_5$ goes low and the detection resistor setting counter produces outputs $S_1=0$, $S_2=1$, $S_3=1$, $S_4=1$. At this time, the smallest detection resistor is selected.

The signal $S_{16}$ goes high, and the P-channel transistor 111 turns ON allowing the caparator to have a reference voltage of $V_{DD}$. Simultaneously, the signal $S_6$ becomes low to cause a current as indicated by the flow line 33 in the same direction as that in which the pulse Pe is applied, the current constituting the pulse $Ps_1$ (FIG. 8). When the signal $S_6$ goes high, the signal $S_{15}$ goes low. When the signal $S_{15}$ is low, the signal a shown in FIG. 7 is low, whereupon the N-channel transistor 38 is de-energized and the detection voltage $Vs_1$ of FIG. 20 is delivered from the point $O_2$ to the comparator 122. Since the detection resistor is of the lowest resistance at this time, the detection voltage becomes a lowest value. As the detection voltage is smaller than Vth' ($=V_{DD}$), the comparator 122 produces a low output. Then, the signal $S_{15}$ goes high when the first step of automatic setting of the detection resistor is completed.

When the sigal $S_{13}$ goes high and then low, the detection resistor is checked in a procedure similar to the foregoing process. When the detection voltage is smaller than the reference voltage Vth', the next step of detection resistance is checked. The resistor is successively changed step-wise until the detection voltage becomes greater than the reference voltage Vth'. When it is detected by the comparator 122 that the detection voltage is larger than Vth', the output of the comparator 122 goes high and is supplied to the NOR circuit 117, rendering the signal $S_8$ high. The RS latch circuit which is composed of the NOR circuits 116, 117 has been reset by the signal $S_7$ which is high when the power supply has been switched on or upon resetting of the analog movement of the hands. When the signal $S_8$ goes high, the signal $S_{11}$ becomes high, setting the detection resistor. With the signal $S_{11}$ going high, the signal $S_5$ goes high to thereby inhibit a count-up pulse for the detection resistor setting counter. When the signal $S_{16}$ goes low, application of the reference voltage for the comparator is prevented, and the detection current and detection sampling are also prevented. Automatic setting of the detection resistor is effected in this manner. Once the detection resistor is automatically set, the detection resistor will remain unchanged unless the power supply is switched on again or the watch is reset by analog movement of the hands. Automatic setting of the detection resistor is completed within one second after oscillation has started upon switching on of the power supply or after the watch has been released from resetting.

The resistance thus established of the detection resistor is confirmed in the next one second. More specifically, a current is caused to flow from the point $O_1$ to the point $O_2$ to rotate the rotor one second after oscillation has begun upon turn-on of the power supply or after releasing the watch from resetting. (The current should flow from the point $O_2$ to the point $O_1$ where the pulse $Pi_1$ was formed by a current flowing from the point $O_1$ to the point $O_2$.) The current generates the pulse $Pi_2$. (FIG. 8) The pulse $Pi_2$ causes the rotor to rotate completely. A rotation detecting current is caused to flow in the same direction as that in which the current for the pulse $Pi_2$ flows, for thereby detecting rotation of the rotor. The signal $S_{19}$ goes high to energize the P-channel transistor 108, causing a current to flow through the resistors 109, 110.

The power supply voltage is divided by the two resistors, and the voltage Vth shown in FIG. 10 is applied to both the comparators 121, 122. At the same time, the signals a, c in FIG. 7 go low to allow a detection current to flow. Then, the signals a, c go high, and simultaneously the signal d goes low, whereupon the detection voltage is delivered from the point $O_2$ to the comparator 122. Since the rotor rotates at this time, the peak value of the detection voltage is normally below the reference potential Vth. The RS latch circuit composed of the NOR circuits 118, 119 has been reset in advance by the signal $S_{17}$ which is high. Therefore, the signal $S_{18}$ remains low. The automatically established detection resistor is now deemed correct in value, whereupon the watch enters a normal mode of operation commencing with the next movement of the hands.

On the other hand, where the peak value of the detection voltage is higher than the reference potential Vth while the rotor is rotating, the output of the comparator 122 goes high, and the signal $S_{18}$ also goes high. At this time, automatic setting of the detection resistor is deemed inappropriate, and the hands of the watch are prevented from moving, whereupon the user of the watch is aware of the fact that the detection resistor has been set improperly. The user can reset the analog watch again repeating the procedure for reliable automatic setting of the detection resistor.

The above process is carried out to set the optimum detection resistor which is best suited for the characteristics of the stepper motor used. This occurs within the detection resistor setting time zone A. The resistance of the detection resistor is fixed in the normal operation subsequent to the zone A. FIG. 28 shows the detection voltage in normal operation. Curve 123 is a detection voltage generated when the rotor does not rotate, with its peak value vu being equal to the detection voltage vsn upon setting of the detection resistor. Curve 124 is a detection voltage produced upon rotation of the rotor, and vr is its peak value. The peak values vu and vr are compared with the reference potential Vth for determination of their relative magnitudes. The present invention is not directed to the process during normal operation, and hence, such process is not here described in detail.

Although in the foregoing description an optimum resistance of the detection resistor can be reached as the detection resistor is increased stepwise in resistance, an optimum resistance may be gained in an alternative embodiment by reducing the detection resistor stepwise, an arrangement which can achieve the objects of the present invention. FIG. 29 shows variations in the detection voltage which are caused by such an alternative process. In FIG. 29, the detection voltage changes from curve 125 to curves 126 to 127 . . . to 130 to 131 as the detection resistor is reduced stepwise. Designated at Vc is a voltage that can be clipped by the diode characteristics of the P type gate. The peak value of the detection voltage is limited by the voltage Vc. The first detection voltage which as a peak value below the reference potential Vth' ($=V_{DD}$) has the waveform 131. The resistance which gives such a voltage waveform may be selecgted to be the detection resistor, or the resistance which generates the detection voltage 130 (having a peak, value $vsn_{-1}$), just one ahead of the detection voltage 131, may be established as the detection resistor.

While in the above description the four resistor elements $r_1$, $r_2$, $r_3$, $r_4$ are connected in series as shown in FIG. 7, the present invention is not limited to four resistor elements but its objects can be achieved generally by using a plurality of such resistor elements. The greater is the number of resistor elements, the higher is the precision. Although the detection resistor elements are coupled in parallel to the transmission gates for obtaining various detection resistances, the present invention is not limited to such a circuit arrangement but other circuit arrangements may be used which can establish the detection resistor in logic processing.

Figure 30:
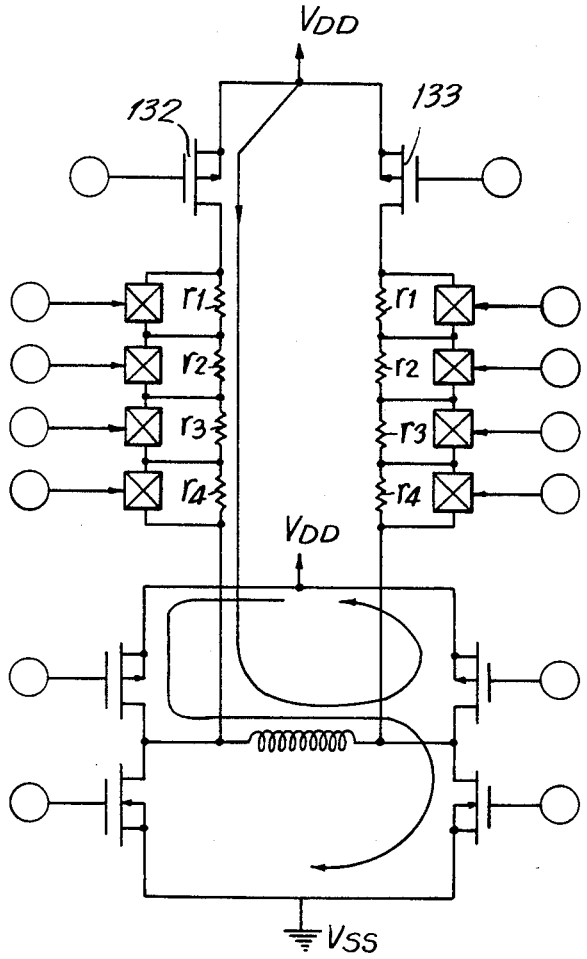
FIG. 30 is an alternative circuit arrangement in accordance with the present invention for detecting whether a rotor has rotated or not.

FIG. 30 is illustrative of another circuit arrangement in accordance with the present invention. With this construction, detection resistor elements $r_1$, $r_2$, $r_3$, $r_4$ are connected in series with P gates 132, 133 that are coupled to a power supply $V_{DD}$. The circuit arrangement falls within the same category as the embodiments described above from the standpoint of logic processing, and hence can provide the advantages of the present invention.

With the invention, as described above, the detection resistor can be established for an optimum resistance by way of logic processing in a detection resistor setting time zone without requiring a precisely fabricated resistor to be connected externally. The arrangement of the present invention can thus meet the demands for small-size, thin, and inexpensive watches.

Even where the resistances of coils of stepper motors vary, resistors can be selected on integral circuits for enabling determination of whether the rotors rotate or not provided there is a relative difference between the waveforms of detection currents produced when the rotors rotate and do not rotate. The present invention is highly advantageous in that variations in mass-produced timepiece can be accommodated.

Integrated circuits of one kind or type can find application with stepper motors of the integral stator type manufactured to all kinds of specifications, thus, contributing to standardization of integrated circuits.

The present invention is of great advantage in that it involves nothing which would lead to an increase in the cost of production, except for the added digital circuit on the existing circuit.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic analog timepiece including a power supply, and a stepper motor to drive hands by 180° rotations of the rotor of said motor, the improvement therein comprising:

a rotation detector circuit, said rotation detector circuit operating to sense whether said rotor of said stepper motor rotated or not upon application of a driving pulse to a coil of said motor, said detector circuit operating after said driving pulse and including:

a detection resistor;

switch means for connecting said coil in first and second states, in said first state said coil being in circuit with said power supply to cause a detection current to flow in said coil, said detection current rising at one rate if said motor rotated in response to said driving pulse and at another rate if said motor did not rotate, said switch means in said second state concurrently connecting said detection resistor in series with said coil to carry said detection current and disconnecting said coil from said power source;

means for detecting the voltage drop across said detection resistor produced by said detection current in said second state, the magnitude of said voltage drop being indicative of whether said rotor did rotate or not by application of said driving pulse;

circuit means for selectively changing said switch means at least from said first to said second state.

2. A rotation detector circuit as claimed in claim 1, wherein said detection resistor comprises a plurality of resistance elements, the resistance of said detection resistor being dependent on the interconnections of said resistance elements, said interconnections being subject to selective variations, whereby the resistance of said detection resistor and said voltage drop are selectively variable.

3. A rotation detector circuit as claimed in claim 2, and further comprising circuit means for automatically varying said interconnections in a programmed sequence, said resistance of said detection resistor varying in accordance with said programmed sequence.

4. A rotation detector circuit as claimed in claim 3, wherein said circuit means for automatically varying said detection resistor is adapted to automatically initiate said programmed sequence upon connection of said power supply to said timepiece circuits and upon releasing said timepiece from a resetting operation, said automatic programmed sequence for selecting a value for said detection resistor occurring prior to initiation of normal timekeeping motions by said motor rotor.

5. A rotation detector circuit as claimed in claim 4, and further comprising a reference voltage source, said circuit means for changing said states of said switch means and for varying said interconnections of said resistance elements being adapted to terminate said programmed sequence when said voltage drop across said detection resistor in response to said detection current has a preselected relationship to said reference voltage.

6. A rotation detector circuit as claimed in claim 2, wherein said resistance elements are formed as component of an integrated circuit.

7. A rotation detector circuit as claimed in claim 6, wherein said resistance elements are formed on said integrated circuit by one of $P^-$ diffusion, $P^+$ diffusion and ion implantation.

8. A rotation detector circuit as claimed in claim 1, wherein said circuit means for selectively changing said switch means at least from said first to said second state, changes said switch means substantially instantaneously.

9. An analog electronic timepiece comprising, at least, an oscillator circuit, a frequency divider circuit, a pulse-width synthesizer circuit, a rotation detector circuit including detection resistors, a reference voltage generator circuit, a stepper motor including a coil, rotor and stator, and an electric cell serving as a power supply, said rotation detector circuit determining whether said rotor of said stepper motor rotates on the basis of the magnitude of a voltage generated across at least one of said detection resistors by a detection current flowing through said coil of said stepper motor and said at least one detector resistor, said rotation detector circuit including means for providing optimum resistance value by selectively combining said detection resistors, a resistance value for said detection circuit being determined in a time period devoted to determining said value.

10. An analog electronic timepiece as claimed in claim 9, wherein said value of said detection resistors is established when said electric cell is switched ON.

11. An analog electronic timepiece as claimed in claim 9, wherein said value of said detection resistors is established within one second after oscillation of said oscillator circuit has started upon switching ON of said electric cell.

12. An analog electronic timepiece as claimed in claim 9, wherein said value of said detection resistors is established within one second after the analog electronic timepiece has been rreleased of resetting.

13. An analog electronic timepiece according to claim 9, wherein said value of said detection resistors is established when the analog electronic timepiece is released of resetting.

14. An analog electronic timepiece according to claim 10, wherein said value of said detection resistors is established when the analog electronic timepiece is released of resetting.

* * * * *